US005413504A

United States Patent [19]

Kloecker et al.

[11] Patent Number: 5,413,504

[45] Date of Patent: May 9, 1995

[54] FERRITE AND CAPACITOR FILTERED COAXIAL CONNECTOR

[75] Inventors: Michael F. Kloecker; David R. Corey, both of Meadville, Pa.

[73] Assignee: NT-T, Inc., Meadville, Pa.

[21] Appl. No.: 221,839

[22] Filed: Apr. 1, 1994

[51] Int. Cl.[6] ..... H01R 13/66

[52] U.S. Cl. ..... 439/620; 333/182

[58] Field of Search ..... 439/620; 333/181-185

[56] References Cited

U.S. PATENT DOCUMENTS

| | | | |
|---|---|---|---|
| Re. 29,258 | 6/1977 | Fritz | 333/705 |
| 3,579,155 | 5/1971 | Tuchto | 333/183 |
| 3,597,711 | 8/1971 | Buckley | 333/183 |
| 4,753,611 | 6/1988 | Kobler | 439/620 |
| 4,772,224 | 9/1988 | Talend | 439/620 |
| 4,797,120 | 1/1989 | Ulery | 439/578 |
| 4,884,982 | 12/1989 | Fleming et al. | 439/620 |
| 4,952,896 | 8/1990 | Dawson, Jr. | 439/620 |
| 4,995,834 | 2/1991 | Hasegawa | 439/620 |
| 5,062,811 | 11/1991 | Hackman | 439/620 |
| 5,145,412 | 9/1992 | Tan et al. | 439/620 |
| 5,167,536 | 12/1992 | Wang | 439/620 |
| 5,213,522 | 5/1993 | Kojima | 439/620 |

OTHER PUBLICATIONS

NT-T, Inc. catalog page entitled Filter Connectors, p. 85.

Trompeter Electronics, Inc. catalog p. 39.

Trompeter Electronics, Inc. catalog p. 34.

*Primary Examiner*—Gary F. Paumen

*Attorney, Agent, or Firm*—Woodard, Emhardt, Naughton, Moriarty & McNett

[57] ABSTRACT

A filtered coaxial connector is provided including an insulated housing, a conductive connector shell concentrically surrounding a center conductor, a ferrite cylinder concentrically located around a portion of the conductive shell and a leadless chip capacitor, one contact of which is electrically connected to the conductive shell. A solid metal washer is electrically connected with the second contact of the chip capacitor. When installed in an enclosure, the metal washer is additionally in contact with the enclosure panel, connecting the capacitor between the connector shell and the enclosure panel. Electrically, the ferrite cylinder is connected in series with the capacitor, thus forming an impedance divider. Common-mode noise generated within the enclosure is applied to this impedance divider, and is shunted through the capacitor to the chassis. As such, common-mode noise generated within the enclosure is attenuated before being permitted to spread throughout the network, via an attached coaxial cable.

10 Claims, 6 Drawing Sheets

FERRITE AND CAPACITOR FILTERED COAXIAL CONNECTOR

BACKGROUND OF THE INVENTION

This invention relates generally to tile field of filtered connectors, and more specifically to a filtered connector including both a ferrite cylinder and a capacitor to filter noise, including electromagnetic interference, generated in the system of which the filtered connector is a part.

In the field of communications there are networks, such as local area networks used with computers, which use coaxial cables to transmit signals. For safety reasons, as well as others, BNC connectors used in computer network applications are not allowed to be tied directly to the chassis of the system enclosure. For example, in a 10 base-2 type network (IEEE standard 802.3) only one point can have a connection to the ground. All other points on the network must remain floating.

FIG. 1 depicts a typical application of the so called 10 base-2 Ethernet connection in a local area network, as discussed above, wherein the shell 40 of a connector 10' is isolated from the chassis enclosure panel 100. Here the data bits are sent at the rate of 10 MHz. The circuit is biased by a dedicated DC/DC converter, which provides an isolated −9 v output. This voltage is used by the transceiver to process the transmitted and received data. Normally, the −9 v return (−9 v ret in FIG. 1) is tied to the shell of the BNC connector. However, the whole I/O area must be galvanically isolated from the rest of the system.

If the circuit shown in FIG. 1 processes high pulsed current or large swings of voltage it may produce interference couples to the BNC connector. This undesired noise could be returned to the source via the chassis enclosure panel, were the BNC shell 40 tied to it. However, the isolation requirement prevents that solution. Thus, the noise may leave the enclosure, flow through a connected cable and then return to the source.

Prior art filtered coaxial connectors have been able to limit the amount of spurious signals transmitted via the cable by using a capacitor (70 of FIG. 1) to shunt some of these signals to the chassis. U.S. Pat. No. 4,797,120 to Ulery, issued Jan. 10, 1989; U.S. Pat. No. 4,884,982 to Fleming et al., issued Dec. 5, 1989; U.S. Pat. No. 5,062,811 to Hackman, issued Nov. 5, 1991; U.S. Pat. No. 5,167,536 to Wang, issued Dec. 1, 1992 and U.S. Pat. No. 5,145,412 to Tan et al., issued Sep. 8, 1992, those patents incorporated herein by reference, show BNC type coaxial connectors having an electrical element connected between the connector shell and either a conductive panel or a printed circuit board for providing a capacitive coupling to the panel or board.

However, while the presence of the capacitor is beneficial in shunting noise to the chassis, the capacitor alone has a limited effect. This is because the capacitor will only work well when it is placed in an environment with relatively high source impedance. If the source impedance is low, the effectiveness of the capacitor is greatly reduced. Thus, there is a need for a device used with a coaxial connector which forces the source impedance to a higher level, to ensure that the capacitor is filtering at an optimal level.

U.S. Pat. No. 4,753,611 to Kobler, issued Jun. 28, 1988, discloses a filtered coaxial assembly including filters for EMI/RFI suppression. These filters have a molded ceramic construction having a lossy ferrite compound dispersed therein. Additionally, that patent describes a method for securing a filter sleeve to the respective inner and outer members of a coaxial cable assembly and assuring mechanical rigidity and electrical contact therebetween. Various embodiments of a filtered connector so produced are described.

U.S. Pat. No. 5,213,522 to Kojima, issued May 25, 1993, discloses a connector with a built-in filter including a ferrite body laving slots corresponding to the connector pins and notches positioned between the slots and a window edge of the case. The notches are contiguous with the slots. Further, chip capacitors are inserted into the notches of the ferrite body, the capacitors being electrically connected between the edge of the shield case and the connector pins.

U.S. Pat. No. 4,995,834 to Hasegawa, issued Feb. 26, 1991, discloses a noise filter connector including an insulation housing, an electrically-conductive shield case, cylindrical capacitors, electrically-conductive post or tab contacts and an inductor block. It is additionally stated that the inductor block is made of a ferrite material and, in connection with the shield case and the capacitors, act as filter devices.

U.S. Pat. No. 4,772,224 to Talend, issued Sep. 20, 1988, discloses a modular electrical connector comprising an insulating body member wherein a plurality of electrical contacts engaged capacitors and which also may be provided with ferrite inductors to produce series inductance.

U.S. Pat. No. 4,952,896 to Dawson, Jr., issued Aug. 28, 1990, discloses a pi-network filter assembly for an electrical connector. The pi-network is comprised of a shunt capacitor at both ends and a series inductor therebetween. Similarly, U.S. Pat. No. 3,597,711 to Buckley, issued Aug. 3, 1971, discloses an electrical connector filter assembly comprising a cylindrical core made of ferromagnetic material and an outer core of dielectric material which is coated by a conductive layer. The assembly provides a removable pi-filter.

U.S. Pat. No. 3,579,155 to Tuchto, issued May 18, 1971, discloses a filtered connector pin contact having a central metal element surrounded by a ferrite ferrule and an outer ceramic sleeve, and including flexible conductive washers end-loading the ferrule and sleeve, to provide flexibility, and prevent breaking.

None of the above references describe a filter for a coaxial connector including a ferrite cylinder concentrically located around the connector shell and a leadless chip capacitor, connected in series, so as to provide improved noise and interference attenuation over a wide range of frequencies. There is a need for such a connector to isolate noise generated in an enclosure from traveling outside the enclosure and along the coaxial-cable to other parts of a computer network.

SUMMARY OF THE INVENTION

One object of the present invention is to provide a filtered coaxial connector for mounting to a conductive enclosure panel of a device which includes a center conductor for conducting a signal through the connector. A conductive shell is located concentrically around and coaxial with the center conductor and the two are separated by an insulated liner. Additionally, a cylindrical inductor is located concentrically around at least a portion of the conductive shell. The cylindrical inductor and at least a portion of the conductive shell are enclosed in an insulated housing, to isolate the conductive shell from the conductive enclosure panel when the filtered coaxial connector is mounted thereto. At least one chip capacitor is electrically connected between the conductive shell and the conductive enclosure panel.

Another object of the present invention is to provide a device which forces the source impedance to a higher level, to ensure that the capacitor is filtering interference, including broadband electromagnetic interference (EMI), at an optimal level.

A further object of the present invention is to provide an improved filtered coaxial connector.

Further objects and advantages of the present invention will become apparent from the description of the preferred embodiment, which follows.

DESCRIPTION OF THE PREFERRED EMBODIMENT

Figure 1:
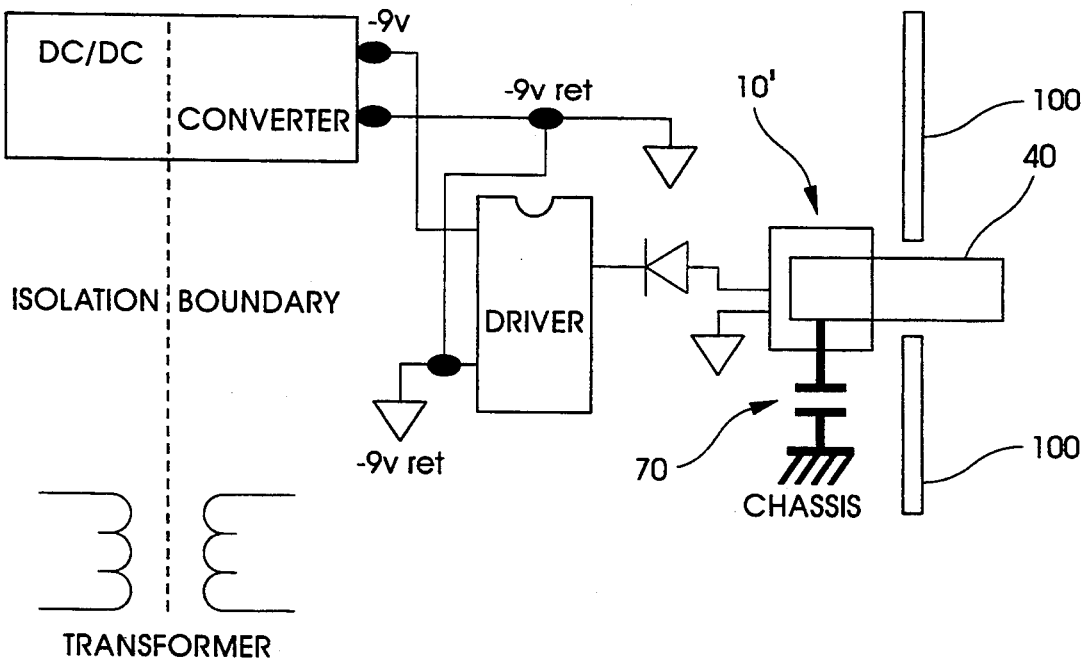
Fig. 1 (Prior Art)
FIG. 1 is a schematic diagram depicting a typical application of the so called 10 base-2 Ethernet connection in a local area network of one type in which the present invention may be used.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
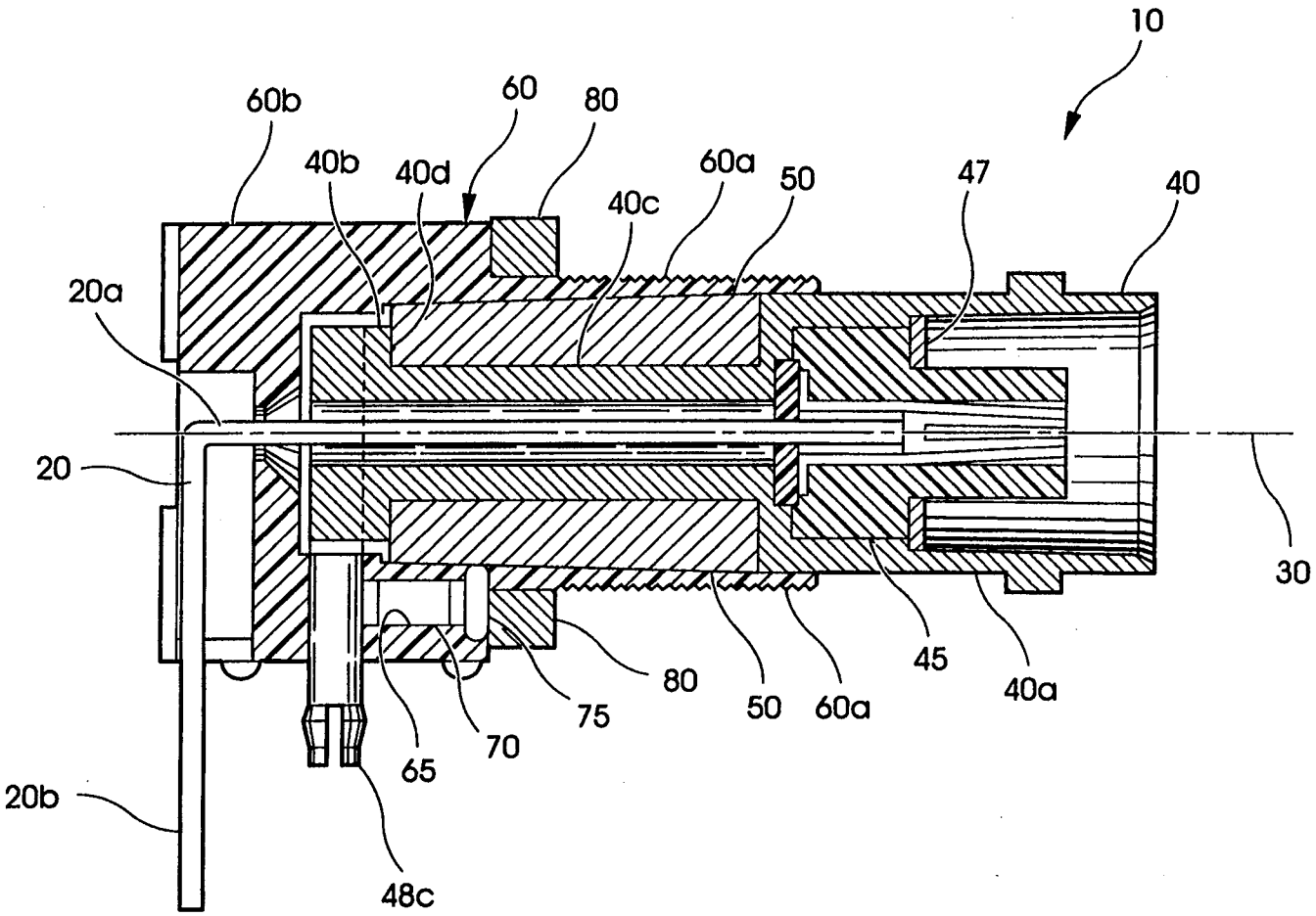
FIG. 2 is a side elevational view in full section of one embodiment of a BNC connector in accordance with the present invention.
Figure 3:
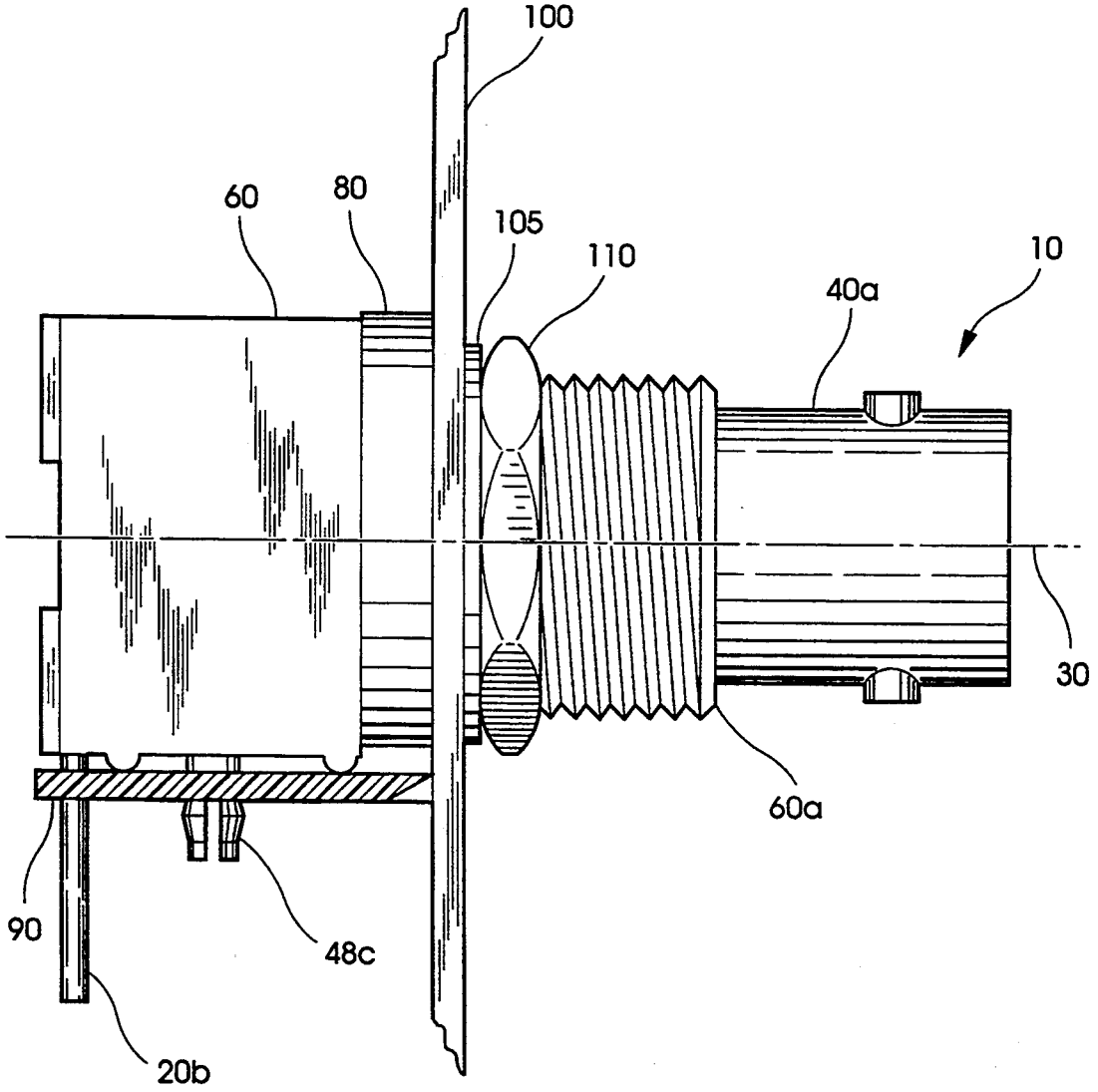
FIG. 3 is a side elevational view of the BNC connector of FIG. 2 connected to a device enclosure panel (the enclosure panel shown in a partial, side elevational view).
Figure 4:
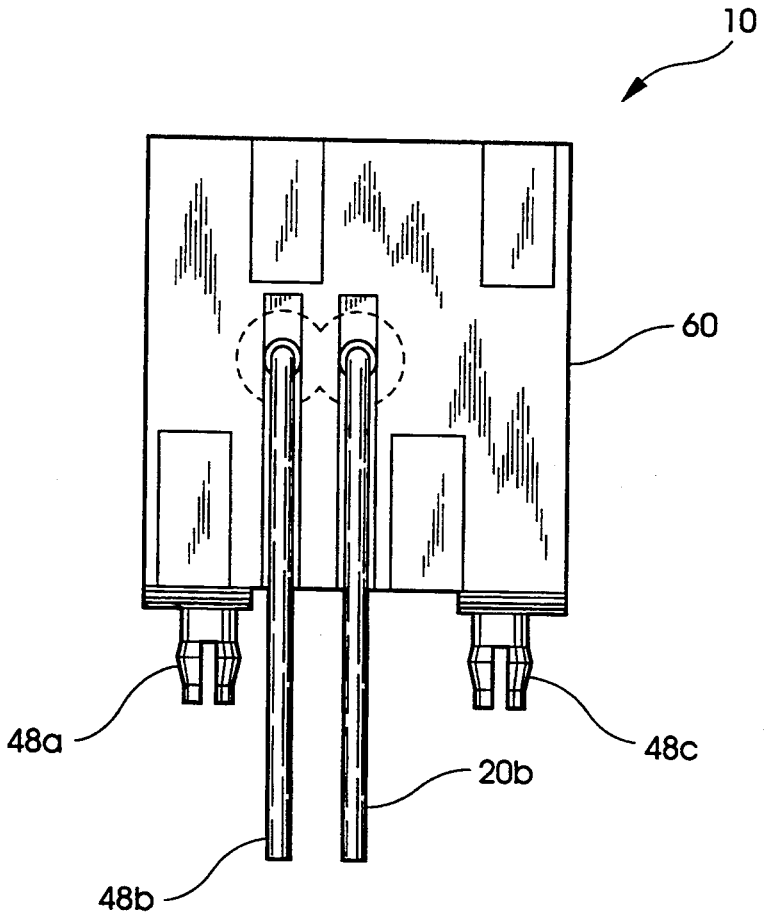
FIG. 4 is a rear elevational view of the BNC connector of FIGS. 2 and 3.

It will be noted here that for a better understanding, like components are designated by like reference numerals throughout the various figures. Referring now to FIGS. 2–4, there is shown one embodiment of a ferrite and capacitor filtered connector 10 according to the present invention. Filtered connector 10 includes an center conductor 20, the main, axial portion 20*a* of which is centered around longitudinal axis 30, and a conductive metal shell 40, which is located concentrically around the main, axial portion 20*a*, and is likewise centered around axis 30. Metal shell 40 may be made in two portions, 40*a* and 40*b* which can be die cast from a conductive material such as zinc and have a nickel plating or may be made from screw-machined brass with a nickel plating. More specifically, filtered connector 10 is a BNC type connector complete with a shell receptacle portion 40*a*, including bayonet connector pins, and a shell body portion 40*b*. Metal shell 40 is designed to interlock with a mating BNC type coaxial connector plug disposed as part of a coaxial cable. The metal shell 40 is electrically connected to the shield conductor of the coaxial cable. Conductive grounding posts 48*a*, 48*b* and 48*c*, which are in contact with the metal shell body potion 40*b* of the metal shell 40, are used to electrically connect the metal shell 40 to the system ground. Further, these grounding posts aid in providing mechanical stability between the conductor and the printed circuit board (PCB) 90 to which it is connected. Although grounding posts 48*a* and 48*c* are shown as having a split configuration, this is not meant to be limiting. Alternatively, grounding posts 48*a* and 48*c* may be of another configuration, for example, a straight cylinder such as is shown in connection with grounding post 48*b*.

As described above, metal shell 40 surrounds the main axial portion 20*a* of the center conductor 20. An insulating liner 45, including sealing washer 47, surrounds the center conductor 20*a* in the shell receptacle portion 40*a* of the metal shell 40. This liner 45 maintains the main axial portion of the center conductor 20*a* centered along the axis 30, and insulates the center conductor 20 from the metal shell 40. Liner 45 is preferably made from an insulating material such as polyethylene or TEFLON®.

In accordance with the teachings of the present invention, a cylindrical inductor or ferrite cylinder 50 is concentrically located about, land in contact with, the reduced diameter section 40*c* of the shell body portion 40*b* of the metal shell 40. The substantially flat end face of ferrite cylinder 50 abuts up against shoulder surface 40*d*. The ferrite cylinder 50 may be chosen based upon such characteristics as bulk resistance, impedance dependency vs. frequency and dielectric constant. The ferrite material should have a suitable bulk resistance such that none, of the signal current will be shunted through the ferrite, thus reducing the current available to drive the coaxial cable. However, since the voltages in computer networking applications are low, on the order of a few volts, choosing a suitable material with the desired bulk resistance should not pose a problem.

Choosing a ferrite material having the desired frequency characteristics is of greater importance, as it is possible to find an optimum ferrite material suitable for a particular frequency range. For RF applications, nickel zinc ferrites are normally used. The dielectric constant of the nickel zinc ferrite is around 13, compared to the dielectric constant of an insulator, which is around 4 or 5.

An insulated housing 60 made up of a block portion 60*b*, and a cylindrical threaded portion 60*a*, surrounds the ferrite cylinder 50, as well as a portion of the shell 40. Grounding posts 48*a–c* pass through and are insulated by the insulated housing 60. Further, a small rectangular chamber 65 is formed in the insulated housing 60. Insulated housing 60 may be made of molded polyethylene, such as appears under the tradename VALOX®, and which is distributed by General Electric Company. Alternatively, the insulators of the present invention may be made from TEFLON®.

A chip capacitor 70 is inserted into the chamber 65 formed in housing 60. Chip capacitor 70 is a leadless, ceramic, multilayer, semiconductor chip type capacitor, having two contacts separated by the dielectric ceramic material. One contact of the chip capacitor 70 is placed directly in contact with one of the grounding posts, such as grounding post 48*c*. As such, the chip capacitor 70 is electrically, as well as mechanically, in contact with the grounding post 48*c*, and through it, the metal shell 40. Capacitor 70 may be chosen so as to minimize the impedance of the capacitor in a desired frequency range. In an ethernet application of the present invention, desirable capacitor values range from 1 to 12 nF, inclusive. In one embodiment, a 1.2 nF capacitor is used. Further, chip capacitor 70 has been chosen to be a leadless semiconductor type chip capacitor so as to limit the parasitic inductances associated with the capacitor packaging.

A conductive plug 75 is placed in contact with the second contact of the chip capacitor 70. A solid metal washer or gasket 80 is then placed over the threaded portion 60*a* of insulated housing 60, and is additionally brought into contact with the conductive plug 75. As such, the washer forces the conductive plug 75 against the capacitor, which in turn is biased into contact with the grounding post 48*c*. The use of a solid metal washer in the present invention is preferable to the use of a spring clip, as a spring clip will corrode and degrade over a much shorter time period than a solid metal washer.

Referring more specifically to FIG. 3, there is shown a side view of the filtered connector 10 mounted on the PCB 90 and mounted through the chassis enclosure panel 100 (shown in partial view). Grounding posts 48*a–c* and the bent portion 20*b* of center conductor 20 (FIG. 2), are mounted through the PCB 90 of the circuitry. Additionally, metal conductors on the PCB 90 electrically connect the grounding posts 48*a–c* to the system ground.

The threads of cylindrical threaded portion 60*a* of insulated housing 60 in the preferred embodiment are plastic, so as to isolate from the shell 40 any further conductive items, such as another washer, which may be placed over the body 60. The cylindrical threaded portion 60*a* is positioned through an opening in the enclosure panel 100, bringing the metal washers 80 into contact with the chassis enclosure panel 100. Thus the entire surface area of one side of the metal washer 80 is in contact with the metal chassis enclosure panel 100. An additional washer 105 is threaded over the insulated housing portion 60*a* and is brought into contact with the other side of the panel 100. A hexagonal nut 110 is threaded over the insulated housing portion 60*a*, and is tightened so as to maintain washers 80 and 105 firmly in contact with the chassis enclosure panel 100. As such, washer 80 is additionally maintained in electrical contact with the chip capacitor 70 (FIG. 2). Electrically, the second contact of the capacitor 70 is connected to the chassis, which is grounded, through the washer 80 and the chassis enclosure panel 100, and optionally, conductive plug 75.

In operation, the filtered connector of FIGS. 2–4, is used to attenuate common-mode noise. Common-mode noise is noise which is running in phase on both sides of the signal. In the present case, this is noise running on the center conductor as well as the shield. The designated return path for this noise is through the capacitor located between the coaxial cable and the enclosure, or chassis ground. The goal of filtering is to minimize the amplitude of the common-mode current reaching the cable. The capacitor 70, acting as a frequency dependent resistor, provides a minimum shunting impedance between the shell 40 of the BNC connector, and the chassis 100. This configuration decouples the shell and all frequencies carried on it greater than or equal to the cutoff frequency. The ferrite provides a series impedance which varies with frequency. Since the ferrite cylinder is encircling the outer shell 40*b* of the BNC connector, it works as a common-mode inductor. Additionally, the desired signal is not affected by the placement of the ferrite, because the signal is driven differentially and magnetic fields created by opposing currents will cancel.

When common-mode noise is induced in the circuit, it will meet the impedance of the dividing network created by the series connection of the ferrite cylinder 50 and the capacitor 70. If this noise is in the frequency range where the ferrite presents significant impedance and the capacitor impedance is low, the filter will attenuate this interference. Further, as the metal washer 80 is located above a small portion (at least less than 50%, preferably less than 25%) of the inductor or ferrite cylinder and is in contact with the panel 100, although separated by an insulator having a relatively low dielectric constant, the washer, insulator, ferrite and shell combination may form a second capacitor within the system.

Figure 5:
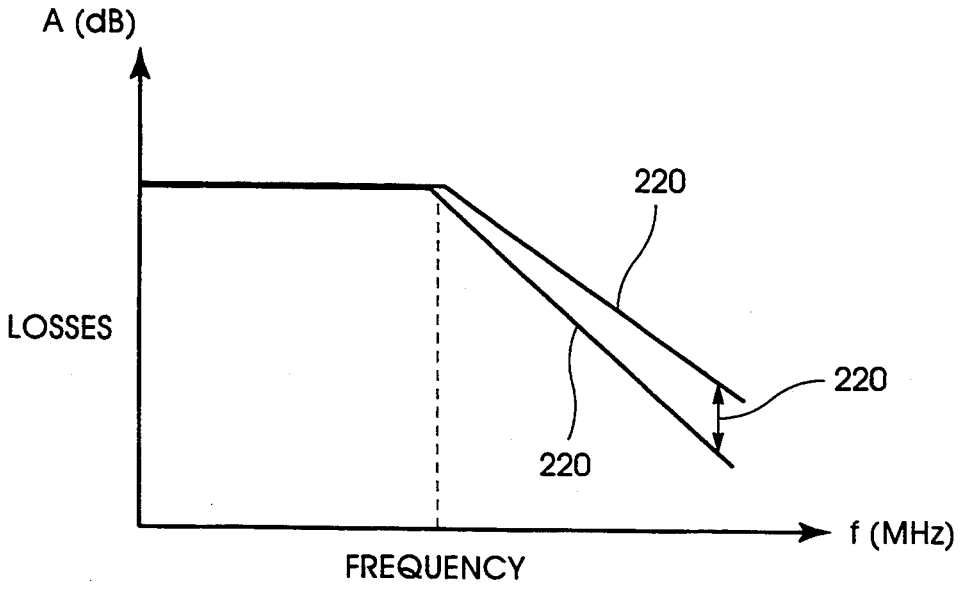
FIG. 5 is a graph showing the insertion losses versus frequency for two differently filtered connectors.
Figure 6:
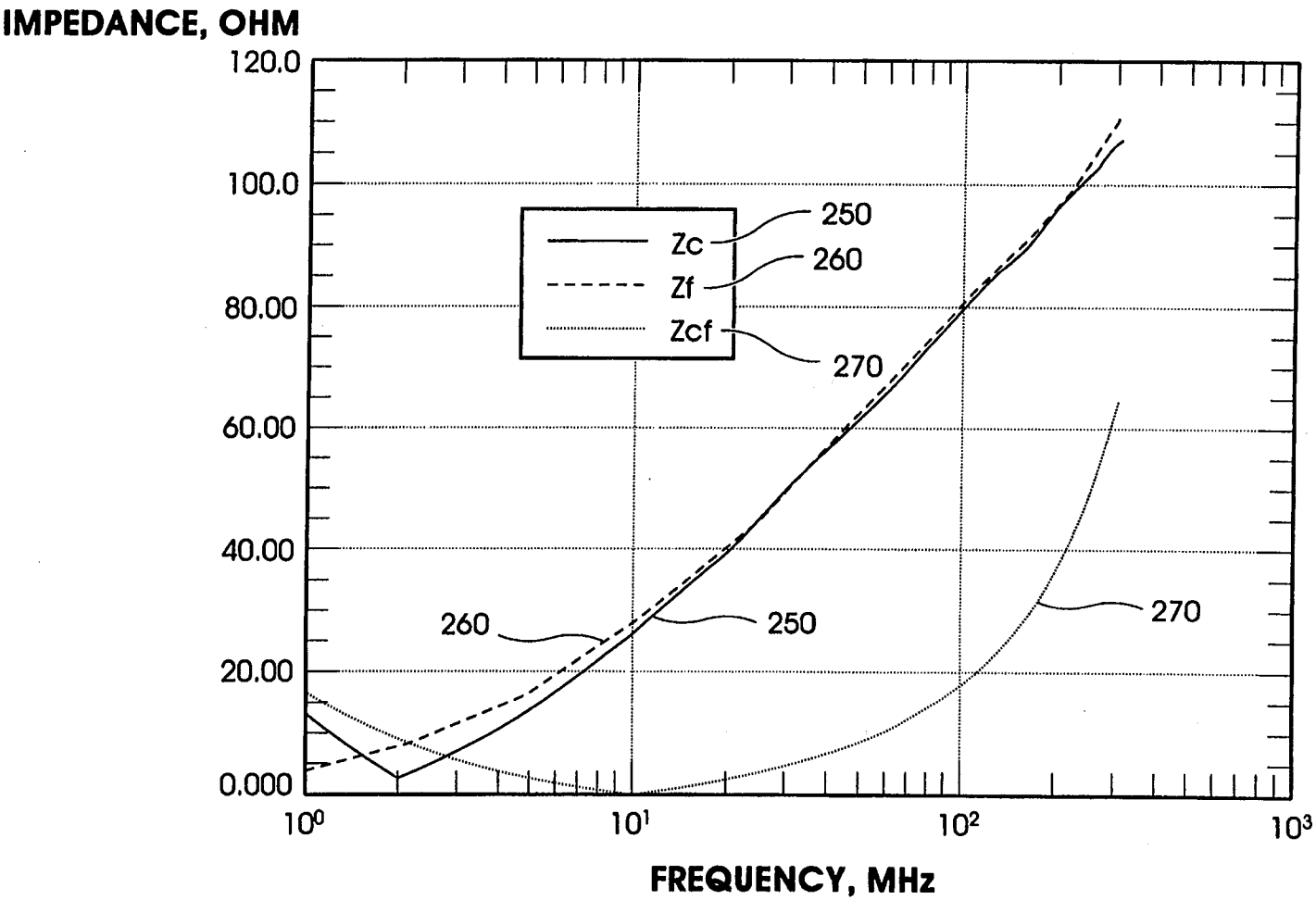
FIG. 6 is a graph showing curves demonstrating the impedance versus frequency relation for three differently filtered connectors.

Experiments were conducted to determine the benefits of using both the ferrite cylinder and the capacitor in series in the filtered connector 10 of the present invention. The results of those experiments are shown in FIGS. 5 and 6. More specifically, FIG. 5 is a graph showing curves representing the insertion losses vs, the frequency of two different BNC connectors, one having the capacitor and the ferrite, the second having only the capacitor. A ratio of output to input was taken, with the understanding being the smaller the ratio, the better the common-mode attenuation of the system. Curve 200 represents the insertion losses of the BNC connector having only a capacitor, while curve 210 represents the losses of the BNC connector having both the capacitor and the ferrite cylinder. As can be seen by the difference amount 220, the connector including the capacitor and the ferrite makes a better filter at higher frequencies. The amount of improvement is determined by the difference at a particular frequency (of which difference 220 is an example). Note, that tile curve of the connector with the ferrite and the capacitor is steeper, and that the gap between the two curves increases as the frequency increases. This is a result of the increasing impedance of the ferrite, which in the experimental case becomes close to 100 ohms at 100 MHZ.

FIG. 6 is a chart showing the results of a second experiment wherein the impedance path through the impedance divider was measured as a function of frequency. Curve 250 represents the impedance vs. frequency curve of the connector having only the capacitor, while curve 260 represents the impedance vs. frequency curve of the connector having only the inductor. Curve 270 represents the impedance vs. frequency curve of the connector having the impedance divider using the series connection of the ferrite cylinder and capacitor. The impedance curves 250 and 260 for the connectors each having only one filter element, were shown to be the expected values. However, the third curve 270 showed much lower impedance over a wide range of frequencies, which is quite different from what would be expected if one could add the two complex impedances of the individual parts. Since one goal of the filtered connector of the present invention is to provide the lowest possible impedance to the reference plane (or chassis, in the present case) over the widest possible frequency range, the combination of a ferrite cylinder inductor and a capacitor is clearly beneficial for the intended applications.

While the invention has been illustrated and described in detail in the drawings and foregoing description, the same is to be considered as illustrative and not restrictive in character. For example, it is not the intention of the inventor to limit the present invention to only BNC connectors, other types of coaxial connectors (TNC, subminiature, etc.) may be used. It being understood that only the preferred embodiment has been shown and described and that all changes and modifications that come within the spirit of the invention are desired to be protected.

What is claimed is:

1. A filtered coaxial connector for mounting to a conductive enclosure panel of a device, comprising:

a center conductor for conducting a signal through the connector;

a conductive shell located concentrically around and coaxial with said center conductor;

an insulated liner disposed between said center conductor and said shell for isolating said center conductor from said shell;

a cylindrical inductor located concentrically around at least a portion of said conductive shell;

an insulated housing surrounding said cylindrical inductor and at least a portion of said conductive shell, to isolate said conductive shell from the conductive enclosure panel, when the filtered coaxial connector is mounted thereto; and at least one chip capacitor having first and second capacitor contacts, said chip capacitor being electrically connected between said conductive shell and the conductive enclosure panel.

2. The filtered coaxial connector of claim 1, wherein said cylindrical inductor is a cylindrical ferrite material.

3. The filtered coaxial connector of claim 2, wherein said insulated housing includes at least one chamber sized to receive said chip capacitor.

4. The filtered coaxial connector of claim 3, additionally including:

at least one ground post electrically connected between said conductive shell and a system ground, wherein the first contact of said at least one chip capacitor is electrically connected to said at least one ground post; and a conductive gasket, electrically connected to the second contact of said at least one chip capacitor, said conductive washer electrically connecting said chip capacitor to the conductive enclosure panel.

5. The filtered coaxial connector of claim 4 wherein said conductive gasket includes a solid metal washer.

6. The filtered coaxial connector of claim 4, additionally including a conductive plug located between said solid metal washer and the second contact of said at least one chip capacitor for biasing said chip capacitor in contact with said at least one ground post when said conductive washer contacts said conductive plug.

7. The filtered coaxial connector of claim 5, wherein said at least one capacitor and said cylindrical inductor are connected in series.

8. The filtered coaxial connector of claim 5, wherein said ferrite material has a nickel-zinc ferrite composition.

9. The filtered coaxial connector of claim 8, wherein said capacitor has a value of between 1 and 12 nF.

10. An isolated filtered coaxial connector for mounting to a conductive member of a device, comprising:

a center conductor for conducting a signal through the connector;

a conductive shell located concentrically around and coaxial with said center conductor;

an insulated liner connected between said center conductor and said shell for isolating said center conductor from said shell;

a cylindrical inductor located concentrically around at least a portion of said conductive shell;

an insulated housing surrounding said cylindrical inductor and at least a portion of said conductive shell, to isolate said conductive shell from the conductive enclosure panel, when the filtered coaxial connector is mounted thereto;

at least one chip capacitor having first and second capacitor contacts, the first capacitor contact being electrically connected to said conductive shell;

a conductive washer electrically connected between said second capacitor contact and the conductive enclosure panel; and a second capacitive device, comprising said conductive washer, at least a portion of said inductor, and said conductive shell, said conductive shell being electrically connected to the conductive enclosure panel.

* * * * *